United States Patent [19]

Viesturs

[11] Patent Number: 4,745,648

[45] Date of Patent: May 24, 1988

[54] BODY SUPPORTING STRUCTURE

[75] Inventor: Eric Viesturs, Southbury, Conn.

[73] Assignee: Connecticut Artcraft Corp., Naugatuck, Conn.

[21] Appl. No.: 88,552

[22] Filed: Aug. 24, 1987

[51] Int. Cl.[4] ..... A47C 27/10; A61G 7/04

[52] U.S. Cl. ..... 5/455; 5/441; 5/451

[58] Field of Search ..... 5/451, 452, 455, 449, 5/450, 422, 441

[56] References Cited

U.S. PATENT DOCUMENTS

| | | | |
|---|---|---|---|
| 3,848,282 | 4/1974 | Viesturs | 5/451 |
| 4,245,364 | 1/1981 | Calleance | 5/451 |
| 4,334,331 | 6/1982 | Santo | 5/451 |
| 4,371,998 | 2/1983 | Callaway | 5/451 |
| 4,517,692 | 5/1985 | Vogel | 5/451 |
| 4,517,693 | 5/1985 | Viesturs | 5/451 |
| 4,571,762 | 2/1986 | Rhoton et al. | 5/451 |

*Primary Examiner*—Alexander Grosz

[57] ABSTRACT

A hollow flexible body adapted to rest upon a mattress has the general shape of a rectangular parallelepiped which is horizontally elongated and is vertically shallow. The body has a closed bottom and sides with a top having a rectangular opening therein. The opening conforms in shape and size to the top but is somewhat smaller whereby a rectangular border separates the opening from the outer peripher of the top of the body. At least one water filled cushion is disposed in the body with a main portion exposed in the opening and with end portions extending in the body underneath the border. The cushion is detachably secured to the body.

2 Claims, 3 Drawing Sheets

BODY SUPPORTING STRUCTURE

BACKGROUND OF THE INVENTION

When bedridden patients have to maintain a substantially motionless position for prolonged periods of time, they develop bed sores, Decubitus Ulcers, on the skin. These sores are formed primarily because the pressure exerted on the skin surface under the bony prominences of the patient, which bear most of the weight of the patient when the patient's body presses against the ordinary mattress, obstructs the circulation of blood in the bony capillaries directly under these surfaces.

Certain types of body support apparatus have been constructed to overlie the mattress and support the patient in such manner as to minimize ulcer formation. Such apparatus is disclosed, for example, in U.S. Pat. Nos. 4,517,693, 4,422,194, and 4,534,078.

The present invention is directed toward a new type of body support apparatus which has the same beneficial action as the known types of apparatus, but which is much less expensive to produce and which can be removed from the underlying apparatus and replaced as necessary by one untrained person of average strength. Moreover this new type of apparatus is constituted by a number of separable components which can be cleaned easily and which can be individually replaced whereby it is not necessary to replace the entire apparatus should one or another component need replacement.

SUMMARY OF THE INVENTION

In accordance with the principles of the invention, a body supporting structure or apparatus comprises a hollow flexible body which is adapted to removably overlie a conventional mattress. The body has the general shape of a rectangular parallelepiped. It is horizontally elongated and relatively shallow with a closed bottom and closed sides and with a top that has an opening, typically a rectangular opening, which is somewhat smaller in area than the area of the top. The periphery of the opening is spaced from the outer periphery of the top by a border.

At least one water filled cushion is disposed in the body with a main portion exposed in the opening and with end portions extending in the body underneath the frame. Means detachably secure the cushion in the body, as for example by using hook and loop type fasteners such as the ones sold under the Trademark of VELCRO or similar strips disposed between the cushion and the bottom of the body.

Normally several cushions are used, and are disposed adjacent each other so that their main portions together essentially fill the opening. Each cushion can be removed and replaced individually. The cushions are sufficiently small and light in weight, even when filled with water, so that they can be easily moved, from place to place, whether water filled or empty, by one unskilled attendant. Each cushion can be filled with water or emptied at a location remote from the bed, thus simplifying the process since it is no longer necessary to have water filling and/or water drain devices disposed adjacent the bed.

DETAILED DESCRIPTION OF PREFERRED EMBODIMENTS

Figures 1, 2:
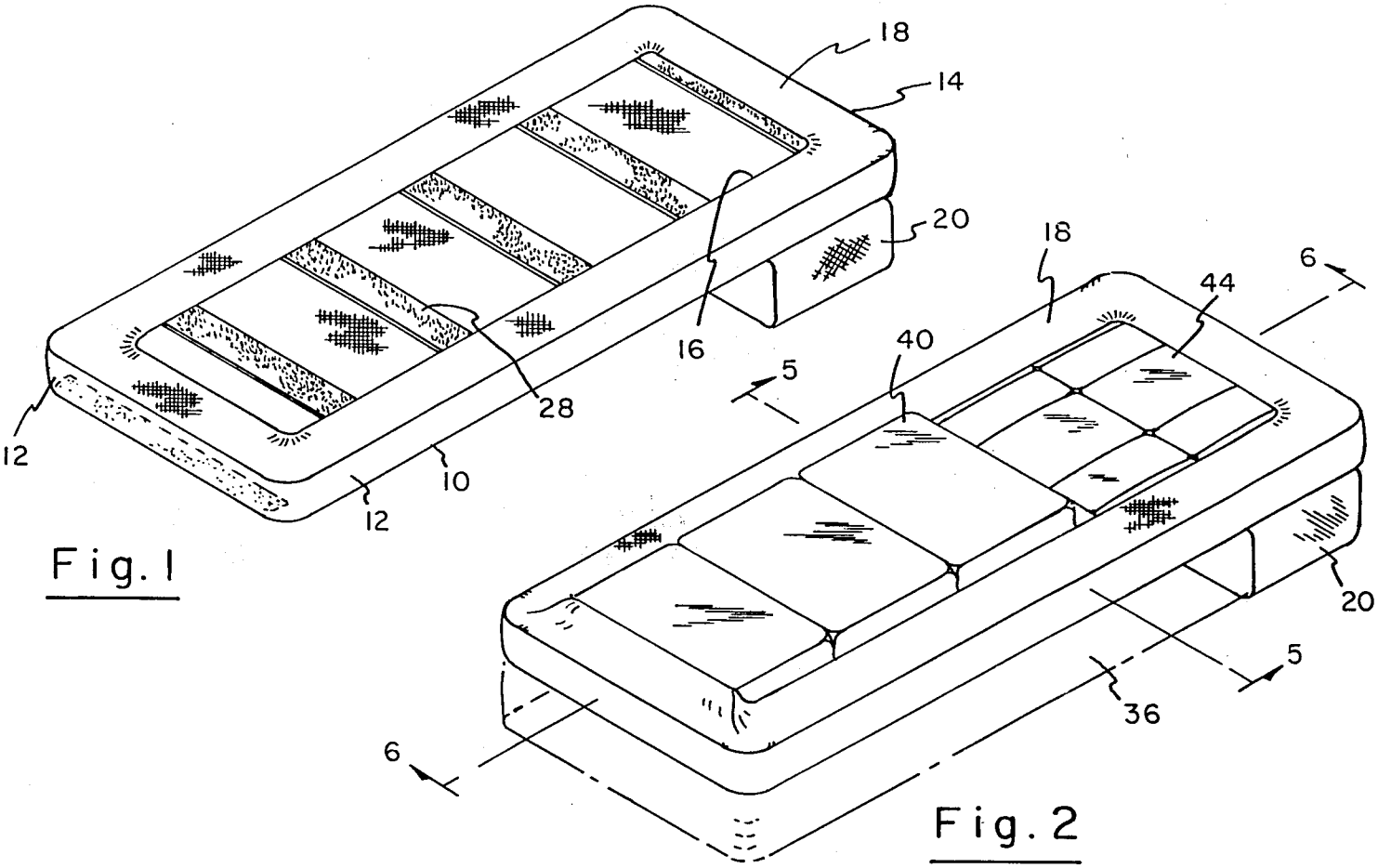
FIG. 1 is a perspective view of the hollow supporting body used in the invention before any cushion has been inserted therein.
FIG. 2 is a view similar to FIG. 1, but showing the cushions in position.
Figures 3, 4:
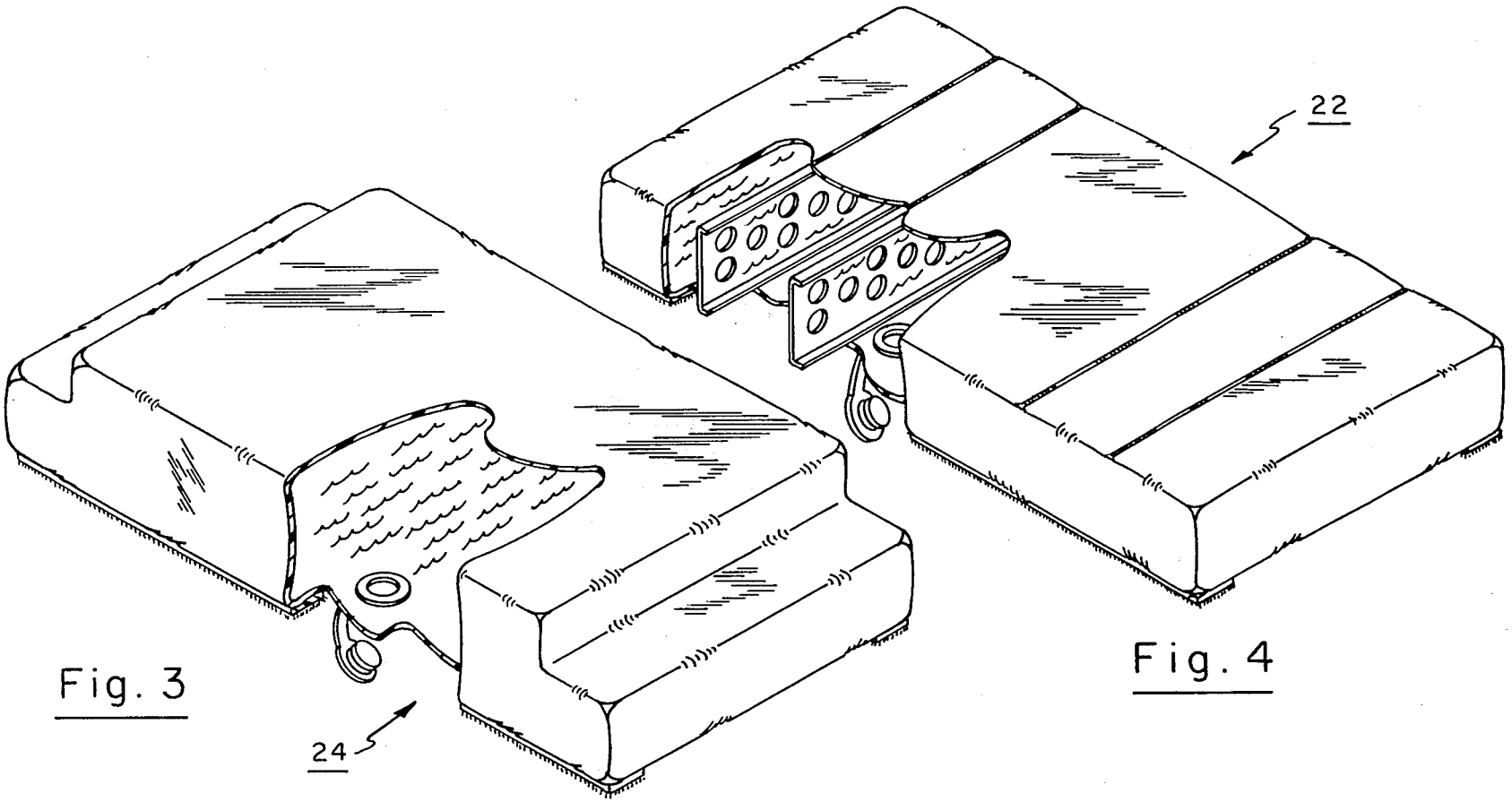
FIG. 3 is a perspective cut away view of one type of cushion used in the invention.
FIG. 4 is a perspective cut away view of another type of cushion used in the invention.
Figure 5:
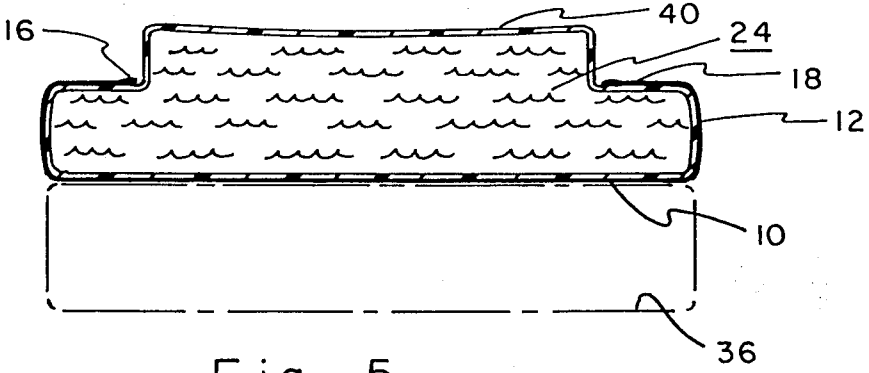
FIG. 5 is a cross-sectional view taken along line 5—5 in FIG. 2.
Figure 6:
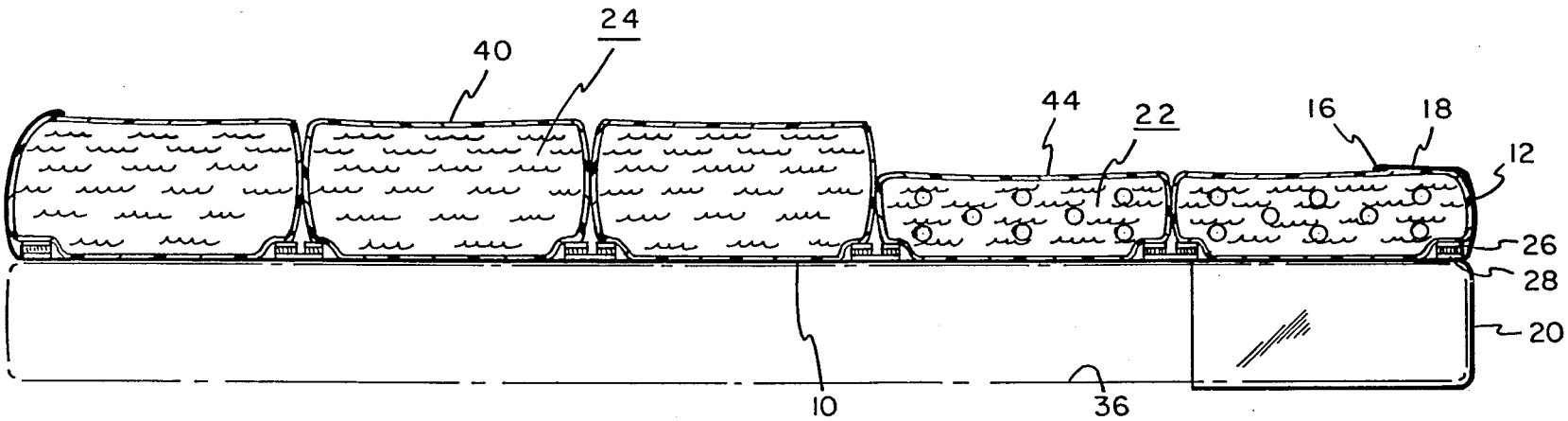
FIG. 6 is a cross-sectional view taken along line 6—6 in FIG. 2.

Referring now to FIGS. 1-6, a hollow flexible body, formed for example of plastic sheeting, has the form of a rectangular parellelepiped which is horizontally elongated, with a flat closed bottom 10, closed sides 12 and a top 14 with a rectangular opening 16 therein. The area of the opening is somewhat smaller than the area of the top. The periphery of the opening is spaced from the outer periphery of the top 14 by a border 18. The body is adapted to lie on a conventional mattress and has a pocket 20 secured to one end of bottom 10 and extending therebelow to detachably receive one end of the mattress to hold the body in position thereon. If desired, another oppositely directed pocket can be secured to the opposite end of the bottom to hold the body more firmly in position. Typically the body can have the length and width of a conventional mattress 36 and is shallow, being several inches deep.

Five cushions are removably disposed in the body. Two of these cushions are of one type 22; three others are of another type 24. Each cushion has two strips 26 of hook and loop type fasteners such as the ones sold under the Trademark of VELCRO secured to opposite sides of the bottom surface which detachably engage mating strips 28 secured to the bottom of the body. All cushions are water filled and have appropriate fill and drain connections 30.

Cushions 24 are vacuum formed and have end portions 38 which lie below main portions 40. Main portions 40 extend upwardly out of the opening. These cushions are known per se and provide more support for hips and legs than the non vacuum formed cushions 22 which are of another known type. Cushions 22 have internal supports or vanes 34 which extend between and are secured to the bottom and top portions of the cushions to prevent collapse. The vanes have holes 32 to permit water to flow therethrough. Vacuum forming allows the cushions 24 to retain the essential shape without the use of vanes. Cushions 22 have main portions 44 which do not extend above the end portions 42. In the drawings, the cushions are shown in the position prior to use. When the body of a user pressed down upon them, the main portions of all cushions are pressed down to approximately the same level. In some applications, it may be necessary to use vacuum formed cushions wherein main portions 40 do not extend above main portions 44 even prior to use.

When the cushions are disposed in the body in water filled condition, the main portions are disposed adjacent each other and essentially fill the opening. The end portions are disposed underneath the border.

Thus each cushion can be separately installed or removed as necessary.

What is claimed is:

1. A body supporting structure comprising:

a hollow flexible body having the general shape of a rectangular parallelepiped which is horizontally elongated and is vertically shallow, said body having a closed bottom and closed sides and a top with a rectangular shaped opening therein, the area of the opening being somewhat smaller than the area of the top so that the periphery of the opening is spaced from the outer periphery of the top by a border, said body being adapted to rest upon a mattress; and a plurality of water filled cushions detachably secured to the body and disposed adjacent each other, each cushion having a main portion disposed in the opening end two opposite side edge portions disposed underneath the border, the main portions together essentially filling the opening, some but not all of the cushions being vacuum formed, the vacuum formed cushions having main portions which are raised relative to both side edge portions in the unloaded condition.

2. The support of claim 1 wherein the bottom of the body has a pocket secured to one end thereof which extends below the body and is adapted to removably receive and enclose the end of a mattress upon which the body rests.

* * * * *